US005729587A

United States Patent [19]

Betz

[11] Patent Number: 5,729,587

[45] Date of Patent: Mar. 17, 1998

[54] X-RAY EXPOSURE APPARATUS

[75] Inventor: Roland Betz, Viereth-Trunstadt, Germany

[73] Assignee: Siemens Aktiengesellschaft, Munich, Germany

[21] Appl. No.: 789,851

[22] Filed: Jan. 28, 1997

[30] Foreign Application Priority Data

Mar. 25, 1996 [DE] Germany ..... 196 11 706.2

[51] Int. Cl.[6] ..... H05G 1/02

[52] U.S. Cl. ..... 378/198; 378/193; 378/195

[58] Field of Search ..... 378/189, 190, 378/193, 196, 197, 198

[56] References Cited

U.S. PATENT DOCUMENTS 5,014,293 5/1991 Boyd et al. ..... 378/196
5,586,162 12/1996 Grichnik ..... 378/189

FOREIGN PATENT DOCUMENTS 295 10 803 11/1995 Germany .
295 17 922 2/1996 Germany .

*Primary Examiner*—Don Wong
*Attorney, Agent, or Firm*—Hill, Steadman & Simpson

[57] ABSTRACT

An x-ray exposure apparatus is freely movable in space without a cable, and allows the electronic production of x-ray images at the bed of a patient. The apparatus includes a cart with an image receiver, such as an amorphous silicon-based solid state detector, to which an image memory on the cart is allocated. Power supply ensues by means of a rechargeable battery that is integrated into the cart.

3 Claims, 1 Drawing Sheet

X-RAY EXPOSURE APPARATUS

BACKGROUND OF THE INVENTION

1. Field of the Invention

The present invention is directed to an x-ray exposure apparatus of the type employing a solid state radiation detector.

2. Description of the Prior Art

X-ray exposure units are known that include, at the end of a C-arm, a source of x-ray radiation and a radiation receiver. The radiation receiver is formed by an x-ray image intensifier whose signals are supplied to an image processing chain via an electrical signal line. Power supply ensues either via a battery charged at a power outlet or via a mains cable. For image processing, a line connection must always be present between the x-ray exposure unit and the image processing chain.

German Utility Model 295 10 803 discloses and x-ray exposure unit that has a C-shaped arm on whose ends are arranged a radiation receiver and a source of x-rays, and which is mounted on a cart. An electronic image memory is also provided on this cart; image information from this image memory can be transmitted via a data interface to an externally connectable apparatus for archiving image data. This x-ray exposure unit is not suited for the production of x-ray exposures at the patient's bedside, such as at a hospital bed. In addition, German Utility Model 295 17 922 shows a movable x-ray apparatus having a source of x-ray radiation mounted movably on a stand, with the stand arranged on a cart that can be driven by a battery-operated electric motor. An x-ray exposure unit is not provided on the cart. The production of x-ray exposures can ensue by the use of x-ray film cartridges slid under the patient.

SUMMARY OF THE INVENTION

An object of the present invention is to provide an x-ray imaging apparatus which is freely movable in space, and in particular can be easily moved to a patient's bed, and wherein an image storage can also ensue in electronic form at the site of exposure.

This object is achieved in accordance with the principles of the present invention in an x-ray imaging apparatus, a cart which carries a battery and an electronic image memory, which supports an electronic image receiver, in particular an amorphous silicon-based solid state detector. The image signals thus can be stored in the image memory while the apparatus is still at the exposure site. The transmission of the stored information to an image processing installation ensues at a fixed location in space, by docking the cart to a suitable processing apparatus. Charging of the battery can also ensue at this location.

The inventive imaging apparatus forms a part of an overall exposure apparatus, the exposure apparatus also including an x-ray source. The x-ray source can be an x-ray source of a mobile x-ray generator, separate from the imaging apparatus, or the imaging apparatus can carry its own x-ray source and the high-voltage supply therefor.

DESCRIPTION OF THE PREFERRED EMBODIMENTS

Figure 1:
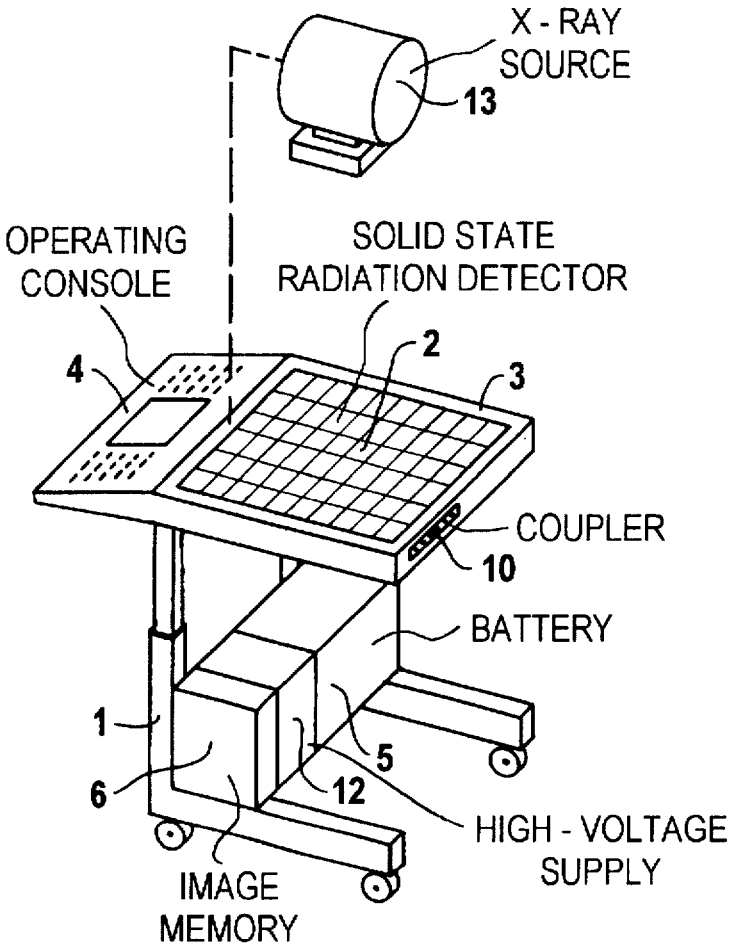
FIG. 1 shows an x-ray imaging apparatus constructed in accordance with the principles of the present invention.

FIG. 1 shows a cart 1 that carries a solid state detector 2, such as an amorphous silicon, on a table 3. The solid state detector 2 is formed by a matrix of detector elements. The table 3 is mounted on the cart 1 so as to be adjustable in height, and supports an operating console 4. On the base of the cart 1, a recharging battery 5 and an electronic image memory 6 are provided. Suitable cables (not shown) between components located at the base of the cart 1 and components located at the table 3 are provided for power supply and data transfer.

For the production of an x-ray exposure, the cart 1 is moved to the exposure site, e.g. to a patient's bed, and the table 3 is set to the required height, and is e.g. slid beneath the patient on the bed. A source of x-rays 13 (such as a mobile x-ray generator apparatus, separate from the imaging apparatus), arranged over the patient, transirradiates the patient. The image information thereby produced by the solid state detector 2 is stored in the image memory 6.

Figure 2:
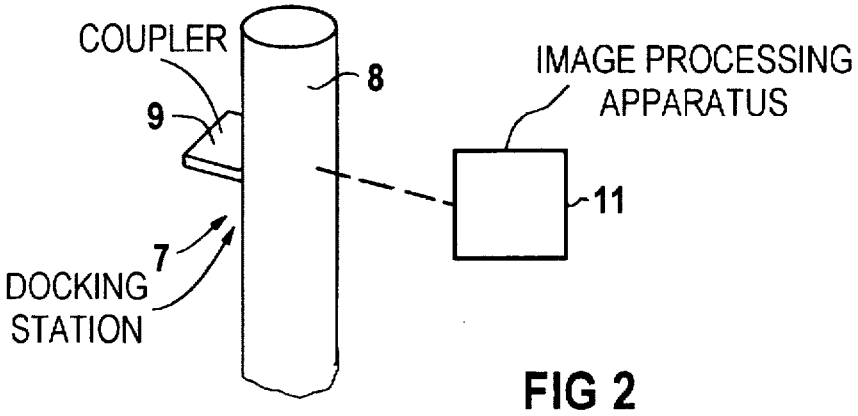
FIG. 2 shows a docking station to which image information from the x-ray imaging apparatus of FIG. 1 is transferred and for charging the x-ray imaging apparatus of FIG. 1.

Afterwards, the cart 1 is moved to a docking station 7 according to FIG. 2, which has an electrical coupling 9 on a column 8, which fits a coupling 10 on the table 3. When the couplings 9 and 10 are connected, the battery 5 is charged and the image information of the image memory 6 is forwarded to an electronic image processing apparatus 11, such as at a remote location.

The cart 1 can alternatively support its own x-ray generator (high-voltage supply) and x-ray source 13, which are likewise supplied by the battery 5. Such a high-voltage supply is schematically shown in FIG. 1 and is designated 12.

Although modifications and changes may be suggested by those skilled in the art, it is the intention of the inventor to embody within the patent warranted hereon all changes and modifications as reasonably and properly come within the scope of his contribution to the art.

I claim:

1. An x-ray imaging system comprising:

an x-ray imaging apparatus comprising a cart having an image receiver formed by a solid state detector oriented in a horizontal plane on said cart an electronic image memory carried by said cart, a battery carried by said cart for supplying power to said image receiver and to said electronic image memory, and a first coupling electrically connected at least to said battery and to said detector, and means for mounting said image receiver on said cart for sliding said image receiver beneath a patient for producing an x-ray exposure of said patient with said x-ray imaging apparatus being self-powered exclusively by said battery; and a docking station having a second coupling, which is mateable with said first coupling, for charging said battery for allowing operation of said x-ray imaging apparatus independently of said docking station to produce an x-ray exposure and for receiving information from said image memory, after production of said x-ray exposure, when said first and second couplings are mated.

2. An x-ray imaging system comprising:

an x-ray source and a high voltage supply for said x-ray source;

an x-ray imaging apparatus comprising a cart having an image receiver formed by a solid state detector oriented in a horizontal plane on said cart an electronic image memory carried by said cart, a battery carried by said cart for supplying power to said image receiver and to said electronic image memory, and a first coupling electrically connected at least to said battery and to said detector, and means for mounting said image receiver on said cart for sliding said image receiver beneath a patient for producing an x-ray exposure of said patient with said x-ray imaging apparatus being self-powered exclusively by said battery; and a docking station having a second coupling, which is mateable with said first coupling, for charging said battery for allowing operation of said x-ray imaging apparatus independently of said docking station to produce an x-ray exposure and for receiving information from said image memory, after production of said x-ray exposure, when said first and second couplings are mated.

3. An x-ray exposure system as claimed in claim 2 further comprising means for mounting said x-ray source on said cart, and wherein said high-voltage supply is carried by said cart.

* * * * *